US011473023B2

(12) United States Patent
Evans et al.

(10) Patent No.: US 11,473,023 B2
(45) Date of Patent: Oct. 18, 2022

(54) HYDROCARBON PYROLYSIS PROCESSES

(71) Applicant: ExxonMobil Chemical Patents Inc., Baytown, TX (US)

(72) Inventors: Christopher M. Evans, Jersey City, NJ (US); James R. Lattner, La Porte, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 16/971,621

(22) PCT Filed: Feb. 7, 2019

(86) PCT No.: PCT/US2019/017064
§ 371 (c)(1),
(2) Date: Aug. 20, 2020

(87) PCT Pub. No.: WO2019/164673
PCT Pub. Date: Aug. 29, 2019

(65) Prior Publication Data

US 2020/0377808 A1 Dec. 3, 2020

Related U.S. Application Data

(60) Provisional application No. 62/634,568, filed on Feb. 23, 2018.

(30) Foreign Application Priority Data

Apr. 26, 2018 (EP) ..... 18169390

(51) Int. Cl.

| | |
|---|---|
| ***C10G 49/04*** | (2006.01) |
| ***C10G 69/06*** | (2006.01) |
| ***C10G 9/00*** | (2006.01) |
| ***C10G 9/36*** | (2006.01) |

(52) U.S. Cl.
CPC ..... *C10G 69/06* (2013.01); *C10G 9/002* (2013.01); *C10G 9/36* (2013.01); *C10G 49/04* (2013.01); *C10G 2300/4006* (2013.01); *C10G 2400/20* (2013.01); *C10G 2400/30* (2013.01)

(58) Field of Classification Search
CPC ..... C10G 9/002; C10G 49/04; C10G 69/06; C10G 2300/4006; C10G 2400/20; C10G 2400/30
See application file for complete search history.

(56) References Cited

U.S. PATENT DOCUMENTS 5,215,649 A * 6/1993 Grenoble ..... C10G 9/00 208/106
2014/0006110 A1 3/2014 Lattner et al.

FOREIGN PATENT DOCUMENTS

JP S5780483 5/1982

* cited by examiner

*Primary Examiner* — Randy Boyer
(74) *Attorney, Agent, or Firm* — Exxonmobil Chemical Patents Inc.; Siwen Chen

(57) ABSTRACT

A hydrocarbon conversion process comprises pyrolysing at a temperature ≥700° C. a feedstock comprising hydrocarbon to produce a pyrolysis effluent comprising at least one $C_2$ to $C_4$ olefin and $C_{5+}$ aliphatic and aromatic hydrocarbons. The pyrolysis effluent is contacted with an oleaginous quench stream to reduce the temperature of the pyrolysis effluent to ≤400° C. At least first and second streams are separated from the cooled effluent. The first stream comprises at least one $C_2$ to $C_4$ olefin, and the second stream comprises a quench oil having an average boiling point at atmospheric pressure of at least 120° C. At least a portion of the second stream is catalytically hydroprocessed to produce a hydroprocessed stream, which is combined with at least a portion of any remainder of the second stream to form the quench stream.

13 Claims, 1 Drawing Sheet

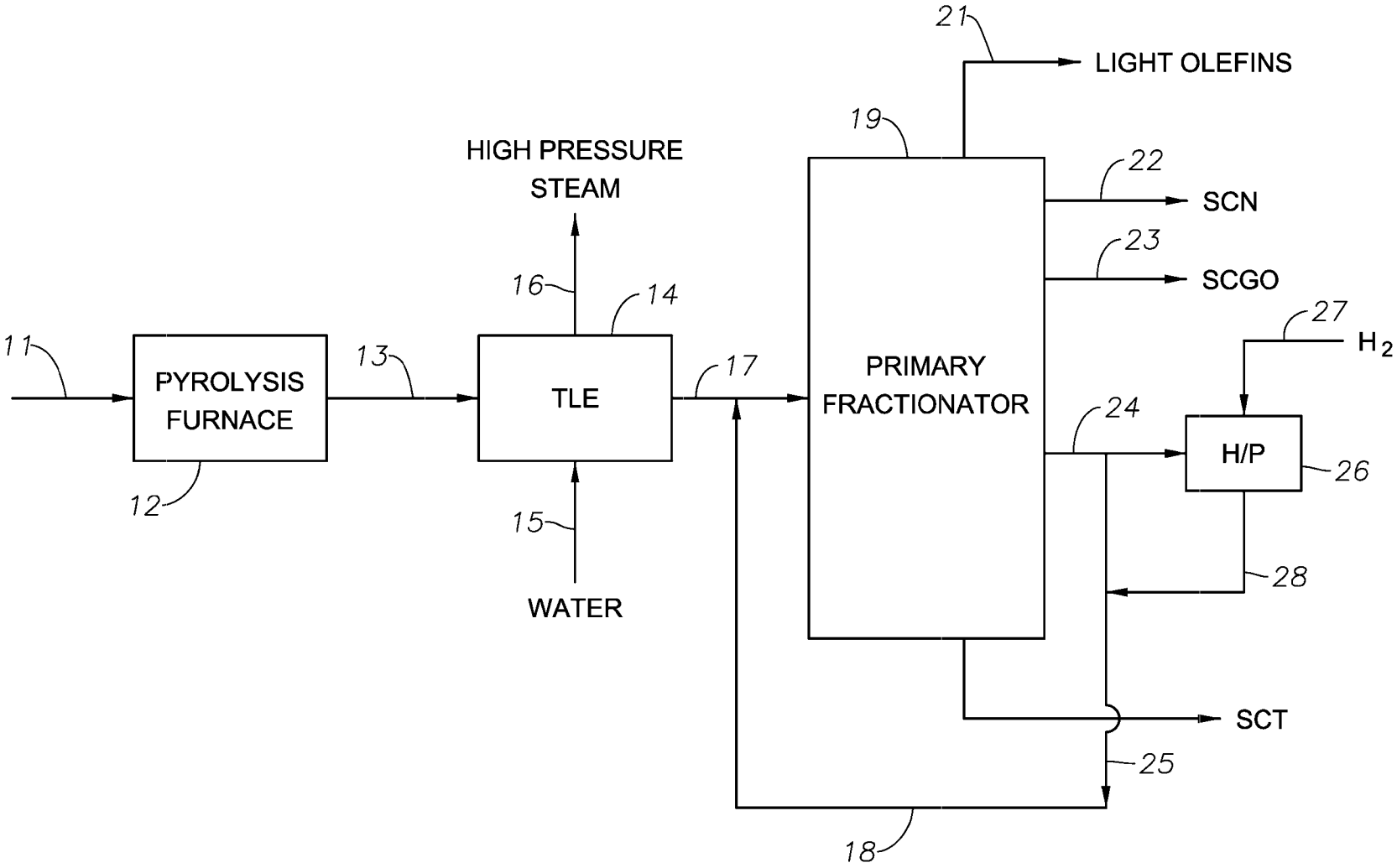
PYROLYSIS FURNACE
TLE
HIGH PRESSURE STEAM
WATER
PRIMARY FRACTIONATOR
LIGHT OLEFINS
SCN
SCGO
H/P
$H_2$
SCT
11
12
13
14
15
16
17
18
19
21
22
23
24
25
26
27
28

HYDROCARBON PYROLYSIS PROCESSES

CROSS-REFERENCE OF RELATED APPLICATIONS

Priority

This application is a National Phase Application claiming priority to P.C.T. Patent Application Serial No. PCT/US2019/017064 filed Feb. 7, 2019, which claims priority to and the benefit of U.S. Provisional Application No. 62/634,568, filed Feb. 23, 2018, and EP 18169390.4 which was filed Apr. 26, 2018, the disclosures of which are incorporated herein by reference.

FIELD

The invention relates to hydrocarbon pyrolysis processes, to quench fluids, to producing such quench fluids, and to using such quench fluids, e.g., for quenching pyrolysis products.

BACKGROUND

Pyrolysis processes, such as steam cracking, are widely utilized for converting saturated hydrocarbons to higher-value products such as light olefins, e.g., ethylene, propylene and butenes. Conventional steam cracking utilizes a pyrolysis furnace having two main sections: a convection section and a radiant section. In the conventional pyrolysis furnace, the hydrocarbon feedstock enters the convection section of the furnace as a liquid (except for light feed stocks which enter as a vapor) where the feedstock is heated and vaporized by indirect contact with hot flue gas from the radiant section and optionally by direct contact with steam. The vaporized feedstock and steam mixture (if present) are then introduced through crossover piping into the radiant section where the cracking takes place. A reactor effluent (pyrolysis effluent) is conducted away from the pyrolysis furnace for further processing, including separating from the pyrolysis effluent the desired light olefins and heavier hydrocarbon products.

Once the desired conversion of the hydrocarbon feedstock has been achieved, the pyrolysis effluent is rapidly cooled, or quenched, to minimize undesirable continuing reactions that are known to reduce selectivity to light olefins. The vast majority of steam cracking furnaces currently in use employ one or more "transfer line exchangers" (TLEs) as the initial cooling media. These devices are heat exchangers for indirectly cooling the pyrolysis effluent via a heat transfer medium such as water, e.g., water in the form of steam. After passage through the TLEs, the pyrolysis effluent can be further cooled, such as from about 650° C. to less than 400° C., e.g., by directly contacting the pyrolysis effluent with a quench medium, e.g., an oleaginous (oil-based) quench fluid, such as a quench oil.

It is conventional to produce quench oil as a distinct cut from a primary fractionator, e.g., a cut between steam cracked gas oil (SCGO) and steam-cracked tar. It is then recycled to the furnace effluent at a rate sufficient to cool the effluent to the desired temperature. The rate depends, e.g., on the temperature of the pyrolysis effluent conducted away from the TLEs, as well as the amount of quench oil vaporization during quenching. Typical ratios of quench oil to furnace effluent (on a weight basis) are about 1:1 to about 5:1, with a ratio of about 2:1 being typical. In an ideal embodiment, a quench fluid would be completely inert at the high temperature of the pyrolysis effluent leaving the TLEs. For each recycle pass, the quench oil achieves high temperatures for a brief moment during initial contact with the pyrolysis effluent before equilibrating to less reactive conditions. The quench oil fraction withdrawn from primary fractionator is not typically withdrawn as a product. Instead it is repeatedly recycled, with withdrawal occurring from time to time as may be needed to prevent an undesired increase in the amount of quench oil in the recycle loop. Individual quench oil molecules thus can reside in the recycle loop for quite a long residence time (on the order of days). Since the quench oil is recycled multiple times during the residence time, each molecule is exposed to repeated severe treatment as residence time increases. Therefore, it is important to have a molecular makeup in the quench fluid that is stable for prolonged times at these severe thermal conditions.

Typically, quench oil fractions produced by pyrolysis units contain as high as 33% (on average) of molecules having at least one olefin moiety, such as vinyl naphthalenes. It is known that heat-soaking process streams with a high olefin content leads to the formation of "heavies", such as tar-like molecules and asphaltenes, and has been proven to plug fixed-bed reactors. The heavies formation proceeds via olefin oligomerization and, when starting with heavy olefins, such as vinyl naphthalenes, only a small number of sequential reaction steps results in insoluble material beginning to foul the surfaces of process equipment. Moreover, the formation of tar-like molecules represents a significant economic downgrade since SCGO and quench oil streams command a significant premium over tar. Similarly, asphaltene formation further downgrades the quality and value of the steam-cracked tar, making any downstream tar conversion technology much more challenging.

In addition to a high olefin content, typical quench oil fractions separated from pyrolysis effluents have been found to contain large quantities, for example of the order of 5 to 10 wt. %, of fluorene and benzothiophene derivatives. These compounds possess very weak C—H bonds which can easily cleave at high temperature creating a cascade of uncontrolled radical chemistry which again can lead to heavies formation.

There is therefore a need for an improved hydrocarbon pyrolysis process in which the generation of heavy hydrocarbons, such as tar and asphaltenes, during oil quenching is reduced.

SUMMARY

According to the present disclosure, it has now been found that the generation of heavy hydrocarbons during oil quenching of hydrocarbon pyrolysis effluents can be reduced by hydrotreating at least a portion of the quench oil fraction in the presence of a catalyst prior to contacting the quench oil fraction with the pyrolysis effluent. The hydrotreating step is believed to hydrogenate at least some of the heavy olefins, such as vinyl naphthalenes, present in the quench oil fraction, thereby decreasing its reactivity as measured by its bromine number. In some embodiments, it may be desirable to reduce the end point of the quench oil fraction to minimize the level of high boiling components, such as fluorene and benzothiophene derivatives.

Thus, in one aspect, the present disclosure resides in a hydrocarbon conversion process comprising:

(a) providing a pyrolysis feedstock comprising ≥10.0 wt. % hydrocarbon based on the weight of the pyrolysis feedstock;

(b) pyrolysing the pyrolysis feedstock at a temperature of at least 700° C. to produce a pyrolysis effluent comprising at least one $C_2$ to $C_4$ olefin and $C_{5+}$ aliphatic and aromatic hydrocarbons;

(c) contacting the pyrolysis effluent with a quench stream to reduce the temperature of the pyrolysis effluent to less than 400° C.;

(d) separating from the cooled pyrolysis effluent vapor at least one $C_2$ to $C_4$ olefin and a quench oil fraction having an average boiling point at atmospheric pressure of at least 120° C.;

(e) contacting at least a first portion of the quench oil fraction with hydrogen in the presence of a hydroprocessing catalyst under conditions effective to produce a hydroprocessed fraction; and (f) combining the hydroprocessed fraction with at least a second portion of the quench oil fraction to form the quench stream sent to step (c).

BRIEF DESCRIPTION OF THE DRAWING

The FIGURE is a flow diagram of a hydrocarbon conversion process according to one embodiment of the present invention.

DETAILED DESCRIPTION OF THE EMBODIMENTS

Described herein is a pyrolysis process, particularly steam cracking, for producing light olefins, e.g., ethylene, propylene and butenes, by cracking at least a portion of a hydrocarbon-containing feedstock. In the process, a feedstock typically comprising ≥10 wt. % of hydrocarbons, typically substantially-saturated hydrocarbons, is pyrolysed at a temperature of at least 700° C. to produce a pyrolysis effluent which contains the desired light olefins but also contains significant quantities of $C_{5+}$ aliphatic and aromatic hydrocarbons. Thus, the typical pyrolysis effluent may contain from 15 to 45 wt % of $C_{5+}$ hydrocarbons ranging in molecular weight from those in the range of steam cracked naphtha (SCN) to those in the range of steam cracker tar (SCT).

The pyrolysis effluent is rapidly cooled to avoid additional reactions, such as oligomerization, which might otherwise reduce the process's selectivity for light olefin production. The rapid cooling can be carried out in one or more TLEs, which cool the pyrolysis effluent by heat exchange with water thereby generating steam, typically at high pressures (e.g. 600-2000 psig). After passage through the TLEs, the pyrolysis effluent is further cooled, such as from about 650° C. to less than 400° C., by direct contact with an quench medium, e.g., an oleaginous quench fluid, such as a quench oil. The quenched mixture of pyrolysis effluent and quench oil is then passed to a primary fractionator for separation from the mixture of at least first and second streams. The first stream comprises a $C_2$ to $C_4$ light olefin fraction, and the second stream comprises a quench oil fraction having an average boiling point at atmospheric pressure of at least 120° C. Besides these, other streams may be separated from the quenched mixture in the primary fractional, e.g., a stream comprising a steam cracked naphtha (SCN) fraction, a stream comprising a steam cracked gas oil (SCGO) fraction, and a stream (typically a bottoms stream) comprising steam cracker tar (SCT).

Aspects of the invention which include producing light olefin by steam cracking and which employ hydrogenation of at least part of the quench oil will now be described in more detail. The invention is not limited to these aspects, and this description is not meant to foreclose other aspects within the broader scope of the invention, such as those which involve pyrolysis in the absence of steam.

Pyrolysis of Hydrocarbon Feeds Steam Cracking

Conventional steam cracking utilizes a pyrolysis furnace which has two main sections: a convection section and a radiant section. The pyrolysis feedstock typically enters the convection section of the furnace where the hydrocarbon component of the pyrolysis feedstock is heated and vaporized by indirect contact with hot flue gas from the radiant section and by direct contact with the steam component of the pyrolysis feedstock. The vaporized hydrocarbon component is then introduced into the radiant section where ≥50% (weight basis) of the cracking takes place. A gaseous pyrolysis effluent is conducted away from the pyrolysis furnace, the pyrolysis effluent comprising products resulting from the pyrolysis of the pyrolysis feedstock and any unconverted components of the pyrolysis feedstock.

The pyrolysis feedstock typically comprises hydrocarbon and steam. In certain aspects, the pyrolysis feedstock comprises ≥10.0 wt. % hydrocarbon, e.g., ≥25.0 wt. %, ≥50.0 wt. %, such as ≥65 wt. % hydrocarbon, based on the weight of the pyrolysis feedstock. Although the pyrolysis feedstock's hydrocarbon can comprise one or more light hydrocarbons such as methane, ethane, propane, butane etc., it can be particularly advantageous to utilize a pyrolysis feedstock comprising a significant amount of higher molecular weight hydrocarbons because the pyrolysis of these molecules generally results in more SCGO than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain embodiments, the hydrocarbon component of the pyrolysis feedstock comprises ≥5 wt. % of non-volatile components, e.g., ≥30 wt. %, such as ≥40 wt %, or in the range of 5 wt. to 50 wt %, based on the weight of the hydrocarbon component. Non-volatile components are the fraction of the hydrocarbon feed with a nominal boiling point above 1100° F. (590° C.) as measured by ASTM D-6352-98, D-7580. These ASTM methods can be extrapolated, e.g., when a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon component of the pyrolysis feedstock can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 weight percent of a particular sample has reached its boiling point. It was surprisingly found that the entirety of the gas oil fraction did not need to be hydroprocessed to substantially decrease heavies formation after quenching, even for feeds comprising ≥5 wt. % of non-volatile components, e.g., ≥30 wt. %, such as ≥40 wt. %, or ≥50 wt. %.

In certain aspects, the hydrocarbon component of the pyrolysis feedstock comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥ about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the hydrocarbon component of the pyrolysis feedstock comprises sulfur, e.g., ≥0.1 wt. % sulfur, e.g., ≥1.0 wt. %, such as in the range of about 1.0 wt. % to about 5.0 wt. %, based on the weight of the hydrocarbon component of the pyrolysis feedstock. Optionally, at least a portion of the pyrolysis feedstock's sulfur-containing molecules, e.g., ≥10.0 wt. % of the pyrolysis feedstock's sulfur-containing molecules, contain at least one aromatic ring ("aromatic sulfur"). When (i) the pyrolysis feedstock's hydrocarbon is a crude oil or crude oil fraction comprising ≥0.1 wt. % of aromatic sulfur and (ii) the pyrolysis is steam cracking, then the SCGO contains a significant amount of sulfur derived from the pyrolysis feedstock's aromatic sulfur. For example, the SCGO sulfur content can be about 3 to 4 times higher than in the pyrolysis feedstock's hydrocarbon component, on a weight basis.

In certain embodiments, the pyrolysis feedstock comprises diluent (e.g., water, particularly water in the form of steam) in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the pyrolysis feedstock comprises hydrocarbon and diluent, wherein:

a. the pyrolysis feedstock's hydrocarbon comprises ≥50.0 wt. % based on the weight of the pyrolysis feedstock's hydrocarbon of one or more of one or more crude oils and/or one or more crude oil fractions, such as those obtained from an APS and/or VPS; waxy residues: atmospheric residues; naphthas contaminated with crude; various residue admixtures; and SCT; and
b. the pyrolysis feedstock's diluent comprises, e.g., ≥95.0 wt. % water (typically substantially all of the water is in the form of steam) based on the weight of the diluent, wherein the amount of diluent in the pyrolysis feedstock is in the range of from about 10.0 wt. % to 90.0 wt. %, based on the weight of the pyrolysis feedstock.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

Cooling and Separation of Pyrolysis Effluent

The primarily-gaseous pyrolysis effluent from the steam cracker is typically at a temperature of at least 750° C., such as from 750° C. to 900° C., and after leaving the steam cracker furnace is rapidly cooled upstream of the primary fractionator. Quenching lessens side reactions which might otherwise reduce the selectivity to the desired light olefins. For example, the pyrolysis effluent can initially be cooled to a temperature in the range of about 700° C. to 350° C. using at least one TLE to produce a cooled pyrolysis effluent. The cooled pyrolysis effluent can further cooled, e.g., by directly contacting the pyrolysis effluent with a quench medium, typically a quench fluid. Alternatively, TLEs are not used, and the pyrolysis effluent is cooled by direct contact with the quench fluid. In aspects where TLEs are used, the quench fluid is typically introduced into the cooled pyrolysis effluent at a location downstream of the transfer line exchanger(s). The quench fluid typically includes a liquid quench oil which, as discussed below, is a recycled fraction from the pyrolysis effluent after at least part of the fraction has undergone hydroprocessing.

A separation system, including a primary fractionator, is utilized downstream of the pyrolysis furnace and downstream of the transfer line exchanger and/or quench point for recovering from the pyrolysis effluent one or more light olefin streams, SCN, SCGO, SCT, and water. Conventional separation equipment can be utilized in the separation stage, e.g., one or more flash drums, fractionators, water-quench towers, indirect condensers, etc., such as those described in U.S. Pat. No. 8,083,931. In addition, the primary fractionator is used to separate a quench oil fraction, which typically is withdrawn as a distinct cut between steam cracked gas oil (SCGO) fraction and the steam-cracked tar. For example, the quench oil fraction may have an average boiling point at atmospheric pressure of at least 120° C., such as least 150° C., with at least 70 wt % of the quench oil fraction having a boiling point at atmospheric pressure less than 290° C., such as less than 250° C. In contrast, the SCGO fraction may have an average boiling point at atmospheric pressure of at least 110° C., with at least 70 wt % of the SCGO having a boiling point at atmospheric pressure less than 200° C. and the SCT fraction may have an average boiling point at atmospheric pressure of at least 250° C., with at least 70 wt % of the SCT having a boiling point at atmospheric pressure of at least 275° C. In some embodiments, the primary fractionator is operated such that the level of fluorene in the quench oil fraction is less than 10 wt %, such as less than 7 wt %, and the level of benzothiophene is less than 5 wt %, such as less than 4 wt %.

Hydroprocessing of Quench Oil Fraction

As separation from the pyrolysis effluent, the quench oil fraction typically contains significant quantities of reactive species (olefins; primarily vinyl napthalenes). As a result, typical quench oil streams have a bromine number as measured in accordance with ASTM D1159 of at least 20, such as at least 25, even at least 30. In this test bromine reacts with olefins in a stoichiometric reaction with 1 mol of bromine per mol olefins. The bromine number is reported as the grams of bromine ($Br_2$) per 100 grams of sample. Therefore, on an absolute basis the quantity of olefins can be compared between different samples.

It is known that heat-soaking process streams with high olefin content (such as SCGO; 38% olefinic) leads to the formation of "heavies", such as tar-like molecules and asphaltenes, which can plug fixed-bed reactors. This reaction proceeds mainly via olefin oligomerization and, when starting with heavy olefins such as vinyl naphthalenes (present in quench oil), it does not take many sequential reaction steps before insoluble material will begin to foul the surfaces of the process equipment. To obviate this problem, the present process reacts at least a portion of the quench oil fraction with hydrogen in the presence of a catalytically-effective amount of at least one hydroprocessing catalyst under conditions effective to reduce olefins therein before the quench oil is recycled into contact with the hot pyrolysis effluent.

Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, and mixtures thereof.

In certain embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst can contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt % of one or more metals selected from Groups 6, 8, 9, and 10 of the Periodic Table and (ii) ≥1.0 wt % of an inorganic oxide, the weight percents being based on the weight of the catalyst.

In one or more embodiments, the catalyst is a bulk multimetallic hydroprocessing catalyst with or without binder. In an embodiment the catalyst comprises at least one Group 8 metal, preferably Ni and/or Co, and at least one Group 6 metal, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, and the support comprises at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source.

The hydroprocessing is carried out in the presence of hydrogen, e.g., by (i) combining molecular hydrogen with the hydroprocessor feed upstream of the hydroprocessing reactor and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥ about 50 vol. % of molecular hydrogen, e.g., ≥ about 75 vol. %, based on the total volume of treat gas conducted to the hydroprocessing stage.

Optionally, the amount of molecular hydrogen supplied to the hydroprocessing stage is in the range of from about 500 SCF/B (standard cubic feet per barrel) (89 S $m^3/m^3$) to 10,000 SCF/B (1780 S $m^3/m^3$), in which B refers to barrel of quench oil feed to the hydroprocessing stage. For example, the molecular hydrogen can be provided in a range of from 500 SCF/B (89 S $m^3/m^3$) to 3000 SCF/B (534 S $m^3/m^3$).

The hydroprocessing is carried out under hydroprocessing conditions including a temperature from 150 to 350° C., such as 150 to 250° C., and a pressure from 500 to 1500 psig (3550 to 10445 kPa-a), such as 1000 to 1400 psig (7000 to 9750 kPa-a). The hydroprocessing conditions also generally comprise a weight hourly space velocity of the hydrocarbon feedstock of from 0.5 to 4 $hr^{-1}$, for example from 1 to 3 $hr^{-1}$, such as from 1 to 2 $hr^{-1}$. Generally, the hydroprocessing conditions are controlled such that the molecular hydrogen consumption rate is in the range of about 200 to 3000 SCF per barrel of the hydrocarbon feedstock or about 36 standard cubic meters/cubic meter (S $m^3/m^3$) to about 564 S $m^3/m^3$, for example in the range of about 300 to about 1500 SCF per barrel of the hydrocarbon feedstock or about 53 standard cubic meters/cubic meter (S $m^3/m^3$) to about 267 S $m^3/m^3$.

Depending on the conditions used in the hydroprocessing, the olefinic content of the quench oil, as measured by its bromine number, can be decreased to less than 10, such as less than 5 by the hydroprocessing described above. As the residence time of quench oil in the system is quite long, it is not necessary to hydroprocess all of the quench oil on each pass. Treatment of a small portion of the quench oil circulation on a continuous basis will, upon steady state, result in a very high fraction of hydroprocessed molecules in the circulating quench oil. Generally, the required olefin reduction can be achieved by hydroprocessing about 1% to about 50% by weight of the circulating quench oil, with a preferred rate being about 10%. For example, the weight ratio of the first portion of the quench oil fraction to the second portion of the quench oil fraction can be in a range of from 0.005 to about 0.9, such as 0.01 to about 0.75, or about 0.01 to about 0.50, or about 0.025 to about 0.4, or about 0.05 to about 0.2. Although the entirety of the quench oil fraction can reside in the first portion +second portion, this is not required. In certain aspects, (i) ≥0.1 wt. %, or ≥1 wt. %, or ≥2.5 wt. %, or ≥5 wt. % of the quench oil fraction resides in the first portion (based on the weight of the first portion), typically 1 wt. % to about 90 wt. %, e.g., 1 wt. % to 50 wt. %, such as 2 wt. % to 30 wt. %, or 5 wt. % to 20 wt. %, or 0.1 wt. % to 20 wt. % or 1 wt. % to 15 wt. %, or more. Those skilled in the art will appreciate that the relative amounts of first and second portions of the quench oil fraction in the quench oil injected at the quench location can be determined by (i) predetermining a desired bromine number for the quench oil to be used for quenching, namely the desired bromine number of the mixture produced by combining the first portion (the hydroprocessed portion) of the quench oil fraction and second portion (the non-hydroprocessed portion of the quench oil fraction; (ii) determining the bromine numbers of each of the first and second portions; and (iii) calculating the relative amounts of the first and second portions that when combined will achieve the predetermined desired bromine number. The predetermined desired bromine number is typically ≤25, e.g., ≤20, such as ≤15, or ≤10, or ≤5, or ≤1. After a first portion of the separated quench oil fraction has been hydroprocessed, the first portion is combined with a second portion of the separated quench oil fraction and contacted with the hot pyrolysis effluent. In some embodiments, the ratio of quench oil (e.g., a quench mixture, such as one comprising the combined first and second portions) to pyrolysis effluent (on a weight basis) is about 1:1 to about 5:1, with a ratio of about 2:1 being preferred. The quench mixture contacting the pyrolysis effluent is typically at a temperature of 50 to 200° C., such as from 80 to 160° C.

One embodiment of the invention is shown in the FIGURE, in which a pyrolysis feed is supplied through line 11 to a pyrolysis furnace 12, where the feed is pyrolysed to produce $C_2$ to $C_4$ olefins and $C_{5+}$ aliphatic and aromatic hydrocarbons. The gaseous effluent from the furnace 12 is then fed through line 13 to one or more transfer line exchangers (TLE) 14, where the effluent undergoes initial cooling by heat exchange with water supplied to the TLE 14 via line 15. The water coolant is converted to high pressure steam in the TLE 14 and is recovered via line 16 for use in either pre-heating the hydrocarbon feed or elsewhere in the refinery.

The partially cooled pyrolysis effluent exits the TLE 14 via line 17 and is then contacted with a quench stream (also referred to as the quench mixture) supplied via line 18. The quench stream further lowers the temperature of the pyrolysis effluent such that the tar fraction condenses from the effluent. The mixture of the quench oil stream and the partially condensed pyrolysis effluent is then passed to a primary fractionator 19, where a cracked gas fraction comprising light olefin is recovered via line 21, a steam cracked naphtha fraction is recovered via line 22, a steam cracked gas oil fraction is removed via line 23, a quench oil fraction is removed via line 24 and a steam cracked tar fraction is removed via line 25. The steam cracked tar and/or the gas steam cracked oil fraction can further processed, e.g., by hydroprocessing, stored, or conducted away. In certain aspects, the quench oil utilized for quenching the hot steam cracked effluent further comprises one or more of steam cracker tar, steam cracker gas oil, hydroprocessed steam cracker tar, and hydroprocessed steam cracker gas oil. It is conventional to flux steam cracked tar with diluent to increase the effectiveness of steam cracked tar hydroprocessing. Besides recovering a hydroprocessed steam cracker tar, it is also conventional to recover from steam cracker tar hydroprocessing an oleaginous stream having a normal boiling point range that is similar to that of the quench oil fraction. It is conventional to recycle and re-use at least a portion of the recovered stream as the diluent. Alternatively or in addition, the quench mixture can be produced by combining at least a portion of the recovered stream with one or more of (i) the first portion (the hydroprocessed portion) of the quench oil fraction (typically combined after hydroprocessing the first portion but optionally before), (ii) the second portion of the quench oil fraction, and (iii) the combined first+second portions. When used, the recovered stream typically comprises 1 wt. % to 25 wt. % of the quench mixture (namely the quench oil utilized for quenching the hot steam cracked effluent), e.g., 2 wt. % to 15 wt. % based on the weight of the quench mixture.

In particular aspects, the quench oil fraction removed from the primary fractionator 19 via line 24 can be divided to produce first and second portions and optionally additional portions. A first portion which is supplied to a hydroprocessing unit 26 containing a hydroprocessing catalyst (not shown). A second portion which is conveyed via line 25 directly for recycle to the quench stream in line 18. In the unit 26 the first portion of the quench oil fraction is reacted with hydrogen introduced to the unit 26 via line 27 under conditions such that olefin content of the olefin content of the first quench oil portion is reduced. The effluent from the unit 26 is then collected via line 28 and mixed with the second quench oil portion in line 25 (and optionally to produce a quench oil mixture.

The invention will now be more particularly described with reference to the following non-limiting Example.

EXAMPLE

A sample of a quench oil from a commercial steam cracker was obtained and tested by gas chromatography/mass spectrometry ("GC/MS", used to determine molecular structure) and bromine number (to quantity olefin content).

It was found that the quench oil is predominantly (>95%) two and three ring aromatic compounds. Broadly, the quench oil sample could be simplified as a combination of methylated naphthalene, biphenyls, anthracenes and fluorenes. Greater than 50% of the sample is composed of dozens of different isomers of mono, di, tri and tetra methylated naphthalenes. However, significant quantities of reactive olefin compounds were observed (notably isomers of vinyl naphthalene and (prop-1-en-2-yl)naphthalene as shown below).

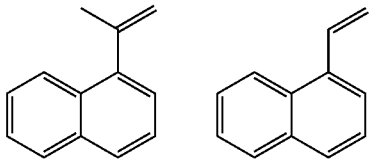

Bromine number analysis (ASTM D1159) was performed on the quench oil sample and samples of SCGO and unfluxed tar from the same steam cracker. These results are shown in Table 1 below. Note that the bromine number is proportional to the position in the primary fractionator with the least olefin content being in the steam-cracked tar.

Since an average molecular weight is known or can be estimated for each sample, the bromine number can be used to calculate the proportion of molecules with an olefin. These results are also shown in Table 1. For SCGO and QO, an average MW was calculated from GC/MS analysis but estimated values of 200 a.m.u. and 500 a.m.u. were used for tar to bracket all possibilities. From these calculations 38% of molecules in SCGO and 24% of tar (using a low estimate of MW) have one olefin. As a result of the very high olefin content, the rate of the $2^{nd}$ order oligomerization reactions between olefins will not be limited by concentration. Rather, this test demonstrates that olefins are abundant in these streams and considering their structural similarity to styrene should be considered very reactive. Not surprisingly, when these process streams are heated at ~400° C. they both form heavies and given enough residence time will plug a fixed-bed reactor.

TABLE 1

| | Bromine No. (g $Br_2$/100 g of sample | Mol % Olefinic molecules | Calculated MW (g/mol) |
|---|---|---|---|
| SCGO | 53.2 | 38.4 | 115.4 |
| Quench Oil | 31.1 | 32.7 | 167.8 |
| Steam Cracked Tar | 19.4 | 24-40 | 200-500 (est) |

To test the effectiveness of hydroprocessing to decrease the olefin content of quench oil, the tar sample was heated at a temperature of 375° C., a pressure of 1200 psig (8375 kPa-a), a WHSV of 0.8 $h^{-1}$ and a $H_2$ feed rate of 3000 SCFB in the presence of a catalyst comprising 3 wt % Co and 9 wt % Mo on an alumina support. The hydroprocessed product had a Bromine Number of 5 to 7, thereby demonstrating significant olefin reduction.

All patents, test procedures, and other documents cited herein, are fully incorporated by reference to the extent such disclosure is not inconsistent and for all jurisdictions in which such incorporation is permitted. While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all patentable features which reside herein, including all features which would be treated as equivalents thereof by those skilled in the art to which this disclosure pertains. Although numerical lower limits and numerical upper limits are listed herein, this description expressly includes ranges from any lower limit to any upper limit.

The invention claimed is:

1. A hydrocarbon conversion process comprising:

(a) providing a pyrolysis feedstock comprising ≥10.0 wt % hydrocarbon based on the weight of the pyrolysis feedstock;

(b) pyrolysing the pyrolysis feedstock at a temperature of at least 700° C. to produce a pyrolysis effluent comprising at least one $C_2$ to $C_4$ olefin and $C_{5+}$ aliphatic and aromatic hydrocarbons;

(c) contacting the pyrolysis effluent with a quench stream having a predetermined bromine number to reduce the temperature of the pyrolysis effluent to less than 400° C. and to obtain a cooled pyrolysis effluent;

(d) separating from the cooled pyrolysis effluent at least one $C_2$ to $C_4$ olefin, a first portion of a quench oil fraction and a second portion of the quench oil fraction, the first and second portions of the quench oil fraction each having an average boiling point at atmospheric pressure of at least 120° C.;

(e) determining a bromine number of the first portion of the quench oil fraction and a bromine number of the second portion of the quench oil fraction;

(f) contacting the first portion of the quench oil fraction with hydrogen in the presence of a hydroprocessing catalyst in a hydroprocessing zone under hydroprocessing conditions effective to produce a hydroprocessed fraction having a bromine number that is less than the predetermined bromine number of the quench stream; and (g) combining at least a portion of the hydroprocessed fraction with at least a portion of the second portion of the quench oil fraction to form a recycle stream having a bromine number that is less than or equal to the predetermined bromine number of the quench stream, wherein the recycle stream forms at least part of the quench stream of step (c).

2. The process of claim 1 and further comprising separating a tar-containing liquid fraction from the cooled pyrolysis effluent.

3. The process of claim 1, wherein the second portion of the quench oil fraction has a bromine number of at least 20, and wherein the predetermined bromine number of the quench stream is less than 10.

4. The process of claim 1, further comprising passing the pyrolysis effluent through a transfer line heat exchanger prior to the contacting of step (c).

5. The process of claim 1, wherein at least 70 wt % of the quench oil fraction has a boiling point at atmospheric pressure less than 290° C.

6. The process of claim 1, wherein at least 70 wt % of the quench oil fraction has a boiling point at atmospheric pressure less than 250° C.

7. The process of claim 1, wherein the separating in step (d) is carried out in a primary fractionator operating under conditions sufficient to provide the first portion of the quench oil fraction and the second portion of the quench oil fraction with less than 10 wt % fluorene.

8. The process of claim 1, wherein the hydroprocessing conditions include a temperature from 150 to 350° C. and a pressure from 500 to 1500 psig.

9. The process of claim 1, wherein the hydroprocessing conditions include a weight hourly space velocity of the quench oil fraction of 0.5 to 4 $hr^{-1}$.

10. The process of claim 1, wherein the hydroprocessing conditions include supplying molecular hydrogen at a rate in the range of from 500 to 10,000 SCF per barrel of the quench oil fraction.

11. The process of claim 1, wherein the hydroprocessing catalyst comprises at least one Group 6 metal and at least one Group 8 metal.

12. The process of claim 1, wherein the hydroprocessing catalyst comprises Mo and Co.

13. The process of claim 1, wherein the weight ratio of quench stream to pyrolysis effluent in the contacting (c) is in the range of from 1:1 to 5:1.

* * * * *